US005996688A

United States Patent [19]

Schultz et al.

[11] Patent Number: 5,996,688

[45] Date of Patent: Dec. 7, 1999

[54] HYDRAULIC PUMP JACK DRIVE SYSTEM FOR RECIPROCATING AN OIL WELL PUMP ROD

[75] Inventors: Glenn Schultz, Calgary; Curtis Phillip Ring, Okotoks; Les Grabill, Calgary, all of Canada

[73] Assignee: Ecoquip Artificial Lift, Ltd., Canada

[21] Appl. No.: 09/066,960

[22] Filed: Apr. 28, 1998

[51] Int. Cl.[6] ..... E21B 43/00

[52] U.S. Cl. ..... 166/72; 166/76.1; 417/377

[58] Field of Search ..... 166/68, 68.5, 72, 166/77.4, 66.6, 66.7, 76.1; 417/390, 377

[56] References Cited

U.S. PATENT DOCUMENTS

| | | | |
|---|---|---|---|
| 1,973,197 | 9/1934 | Baker | 255/10 |
| 2,282,977 | 5/1942 | Mast | 60/52 |
| 2,526,388 | 10/1950 | Miller | 60/54.5 |
| 2,555,426 | 6/1951 | Trautman et al. | 60/52 |
| 2,560,676 | 7/1951 | White | 60/51 |
| 2,645,900 | 7/1953 | Hutchison | 60/52 |
| 2,651,914 | 9/1953 | Joy | 60/51 |
| 2,699,154 | 1/1955 | Smith | 121/164 |
| 2,726,512 | 12/1955 | Deitrickson | 60/51 |
| 2,728,193 | 12/1955 | Bacchi | 60/51 |
| 2,729,942 | 1/1956 | Billings et al. | 60/52 |
| 2,838,910 | 6/1958 | Bacchi | 60/52 |
| 2,853,057 | 9/1958 | McAuley | 121/150 |
| 2,982,100 | 5/1961 | Sinclair | 60/51 |
| 3,491,538 | 1/1970 | Pearson | 60/52 |
| 4,448,110 | 5/1984 | Polak et al. | 91/275 |
| 4,474,002 | 10/1984 | Perry | 60/369 |
| 4,546,607 | 10/1985 | Kime | 60/372 |
| 4,616,981 | 10/1986 | Simmons et al. | 417/378 |
| 4,631,918 | 12/1986 | Rosman | 60/372 |
| 4,646,517 | 3/1987 | Wright | 60/371 |
| 4,707,993 | 11/1987 | Kime | 60/372 |
| 4,762,473 | 8/1988 | Tieben | 417/399 |
| 4,848,085 | 7/1989 | Rosman | 60/372 |
| 4,861,239 | 8/1989 | Simmons | 417/383 |
| 4,899,638 | 2/1990 | Brown | 91/346 |
| 5,447,026 | 9/1995 | Stanley | 60/372 |
| 5,832,727 | 11/1998 | Stanley | 60/372 |

OTHER PUBLICATIONS

Tieben Inc. Brochure, U.S.A., Publication date unknown.
Peacock Inc. Brochure, Canada, Publication date unknown.

*Primary Examiner*—Frank S. Tsay
*Attorney, Agent, or Firm*—Merek & Voorhees

[57] ABSTRACT

A hydraulic pump jack drive system for reciprocating an oil well pump rod. The drive system comprises at least one hydraulic well head cylinder, a reversible flow hydraulic pump, and a master cylinder. The master cylinder has a free floating master piston and at least one fixed bulkhead. The master cylinder also has a working fluid chamber hydraulically connected to the hydraulic well head cylinder and at least two master piston drive chambers hydraulically connected to the hydraulic pump. The hydraulic well head cylinder and the working fluid chamber are filled with a working fluid and define a working fluid system while the master piston drive chambers and the hydraulic pump are filled with hydraulic fluid and define a hydraulic drive system. Reversing the flow of the hydraulic pump causes the master piston drive chambers to be pressurized and de-pressurized on an alternating basis to reciprocally move the master piston within the master cylinder. The reciprocating master piston causes an alternating pressuring and de-pressurizing of the working fluid chamber and the well head cylinder thereby causing the pump rod to reciprocate within the oil well.

29 Claims, 7 Drawing Sheets

HYDRAULIC PUMP JACK DRIVE SYSTEM FOR RECIPROCATING AN OIL WELL PUMP ROD

FIELD OF THE INVENTION

This invention relates to a hydraulic pump jack drive system for reciprocating an oil well pump rod within an oil well. The pump rod is reciprocated by well head cylinders that are driven by a master cylinder powered by a reversible flow hydraulic pump.

BACKGROUND OF THE INVENTION

Oil wells typically vary from a depth of a few hundred feet to several thousands and in many instances can exceed 10,000 feet in depth. In many oil wells there is insufficient in situ pressure to affect the flow of oil out of the well to the surface. For that reason a variety of different pumping and extraction devices have been developed to pump or urge oil from a well. The most common of such devices is a reciprocating pump that is installed deep within the well and operated by a reciprocating pump or sucker rod extending from the pump to the well head at the ground surface.

A significant amount of effort has been directed toward the development of various devices that can be utilized in order to reciprocate a pump or sucker rod in an effective manner to extract oil from a well. Traditionally the pump rod has been reciprocated by a device known as a pump jack which operates through the rotation of an eccentric crank driven by an electric, gasoline or diesel motor. Such mechanical drive mechanisms have been utilized extensively in the oil production industry for decades and continue to be the primary method for extracting oil from a well. However, they suffer from a number of inherent disadvantages or inefficiencies. These inefficiencies include their substantial size and weight that makes them expensive to produce, difficult to transport and expensive to install. The mass of such units also requires significant structural support elements at the well head which adds to the complexity and expense of the overall drive system. Furthermore, mechanical drive systems have components that are physically linked or connected in some form by way of connecting rods, cams, and gear boxes. For a variety of different reasons it often becomes necessary to adjust the travel of the pump rod. Mechanical linkages, as have previously been used, present difficulties in adjusting the travel or displacement of the pump rod. Under prior art devices adjusting rod displacement and pumping speed requires the drive system to be shut down, wasting valuable production time and increasing labour costs. Mechanically driven pump jacks are also limited in their ability to control acceleration and deceleration of the pump rod during its reciprocation.

To combat these limitations in mechanical pump jack drive systems, others have proposed a variety of different pneumatic and hydraulic drive mechanisms that have met with varying degrees of success. Most require the placement of some form of hydraulic cylinder on the well head to raise and lower the pump rod. Such drive systems utilize a connecting rod that is driven, through an eccentric cam or crank, by an electric, gasoline or diesel motor. Since the primary mode of powering the drive systems remains a mechanical linkage, such systems, to a large extent, still suffer from the same inherent difficulties of rod speed and stroke control as do the prior purely mechanical pump jacks.

SUMMARY OF THE INVENTION

The invention therefore provides a drive system for reciprocating a pump rod in an oil well that addresses the limitations of such prior devices. The invention provides a hydraulic pump jack drive system having at least one hydraulic cylinder mounted at the well head for reciprocating the pump rod within the well. The hydraulic well head cylinder is powered by a master cylinder which is driven hydraulically by a reversible flow hydraulic pump In particular, in one of its aspects the invention provides a hydraulic pump jack drive system for reciprocating an oil well pump rod, the drive system comprising at least one hydraulic well head cylinder having a well head piston, said well head piston connected to the oil well pump rod causing the pump rod to reciprocate in the oil well upon raising and lowering of said well head piston; a reversible flow hydraulic pump; and, a master cylinder having a cylinder shell, a free floating master piston retained therein, and at least one fixed bulkhead, said master cylinder having a working fluid chamber hydraulically connected to said hydraulic well head cylinder, and at least two master piston drive chambers hydraulically connected to said hydraulic pump, wherein the cyclical reversing of the flow of said hydraulic pump causes said master piston drive chambers to be pressurized and de-pressurized on an alternating basis to reciprocally move said master piston within said master cylinder, said reciprocating master piston causing an alternating pressurizing and de-pressurizing of said working fluid chamber and said well head cylinder thereby causing the pump rod to reciprocate within the oil well.

In a further aspect of one embodiment of the invention the master cylinder has a lower and an upper fixed bulkhead and the master piston has a piston head having an upper and a lower piston rod extending therefrom and situated longitudinally within the cylinder shell, the piston head being positioned between said upper and said lower fixed bulkheads and said upper and lower piston rods extending through said respective upper and lower fixed bulkheads with said bulkheads forming fluid tight seals therewith.

In a further aspect of an alternate embodiment of the invention the master piston has a first and a second piston head joined by a connecting rod, the first and second piston heads being positioned on opposite sides of the bulkhead with the bulkhead bearing against the connecting rod to form a fluid tight seal therewith.

In an aspect the invention includes at least one pressure balancing valve to automatically control and maintain pressure in an accumulator, that is hydraulically connected to the energy storage chamber, within a desired range, said pressure balancing valve being hydraulically connected to said hydraulic pump and to the accumulator.

In yet a further aspect the invention includes a working fluid volume control system to automatically add working fluid to said working fluid system.

In a still further aspect the master cylinder includes a second working fluid chamber hydraulically connected to a hydraulic well head cylinder that reciprocates the pump rod in a second oil well.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, this specification and the drawings that follow only describe and disclose some of the specific forms of the invention and are not intended to limit the scope of the invention as defined in the claims that follow herein.

Figure 1:
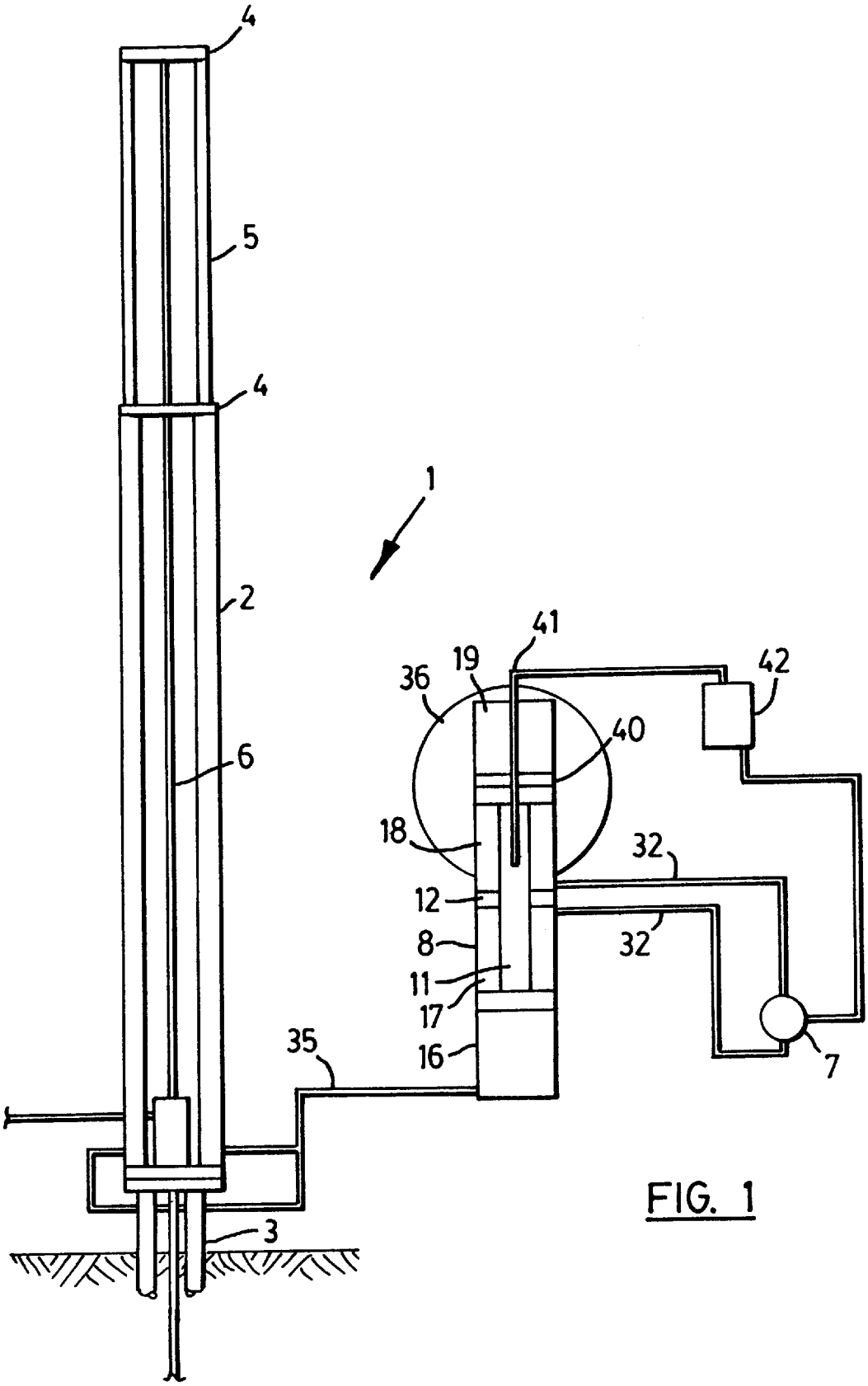
FIG. 1 is a schematic drawing of the hydraulic pump jack drive system of the present invention.

With reference to FIG. 1, the hydraulic pump jack drive system 1 according to the present invention contains at least one hydraulic well head cylinder 2 positioned on an oil well head 3. In the preferred embodiment two hydraulic well head cylinders are used and are positioned on opposite sides of the well head casing. A pair of transversely mounted cylinder tie members 4 are used to hold the cylinders a fixed distance apart such that their internal well head pistons 5 operate parallel to one another. The pump, sucker or polished rod 6 is attached in any one of a variety of known manners to one or more of the tie members 4 such that reciprocation of well head pistons 5 results in reciprocation of the pump rod within the well. It will be appreciated that while the support structure for the well head cylinders is not shown in the drawings it will be necessary to support the cylinders such that they are held rigidly upon the well head. This is particularly important in inclined or slanted well situations where well head cylinders 2 may not be vertically oriented. Additional supports may be necessary in such conditions. It will also be appreciated that while cylinders 2 are shown as being positioned on the well head, they could equally be mounted adjacent to or within the well head.

Figure 2:
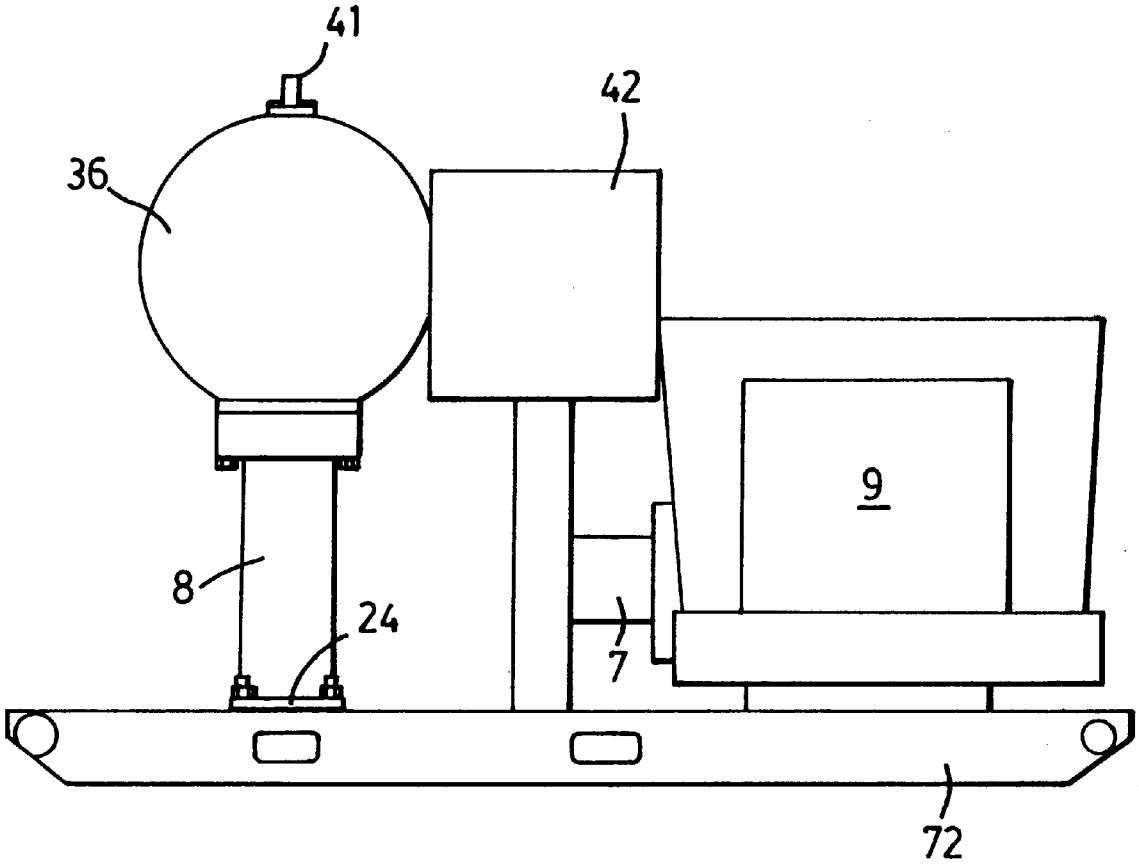
FIG. 2 is a side view of the power unit of the present invention.

Hydraulic pump jack drive system 1 also includes a reversible flow hydraulic pump 7 and a master cylinder 8. Hydraulic pump 7 is preferably an electrically controlled swash plate pump and provides the main mode of powering the master cylinder which in turn provides the driving force applied to well head piston 5 in order to reciprocate pump rod 6. The precise flow operation of hydraulic pump 7 will be described in more detail later. Pump 7 is preferably driven by an electric, gasoline or diesel motor or engine 9 (see FIG. 2) that may be connected directly to hydraulic pump 7 or may be indirectly connected through a belt drive, chain drive, transmission or a gear box.

Master cylinder 8 is comprised generally of a cylinder shell 10 having an internal free floating master piston 11 retained therein. Master piston 11 is free floating in that it is not physically connected to any external drive system by way of a drive rod or crank, as is the case in master cylinders that are employed in some hydraulic systems. Instead, master piston 11 is free to float longitudinally through cylinder shell 10 being structurally restricted only by way of a bulkhead 12, positioned at approximately the mid-point along the longitudinal axis of cylinder shell 10. Bulkhead 12 contains a bulkhead seal 25 on its interior surface. As will be apparent from FIG. 1, master piston 11 is itself comprised of first and second piston heads, 13 and 14 respectively, that are joined by a connecting rod 15. Connecting rod 15 may be comprised of either a solid rod or hollow tubular member. First piston head 13 and second piston head 14 are situated on opposite sides of bulkhead 12 with bulkhead seal 25 bearing against connecting rod 15 and forming a fluid tight seal therewith. This structure of cylinder shell 10, bulkhead 12, and free floating double ended master piston 11 will thus create four separate and distinct sealed chambers within the master cylinder. These four chambers comprise a working fluid chamber 16, a first master piston drive chamber 17, a second master piston drive chamber 18, and an energy storage chamber 19. It will also be appreciated that depending upon the particular configuration of connecting rod 15, multiple master piston drive chambers could be created, however, in the preferred embodiment only two such chambers are utilized.

Figure 3:
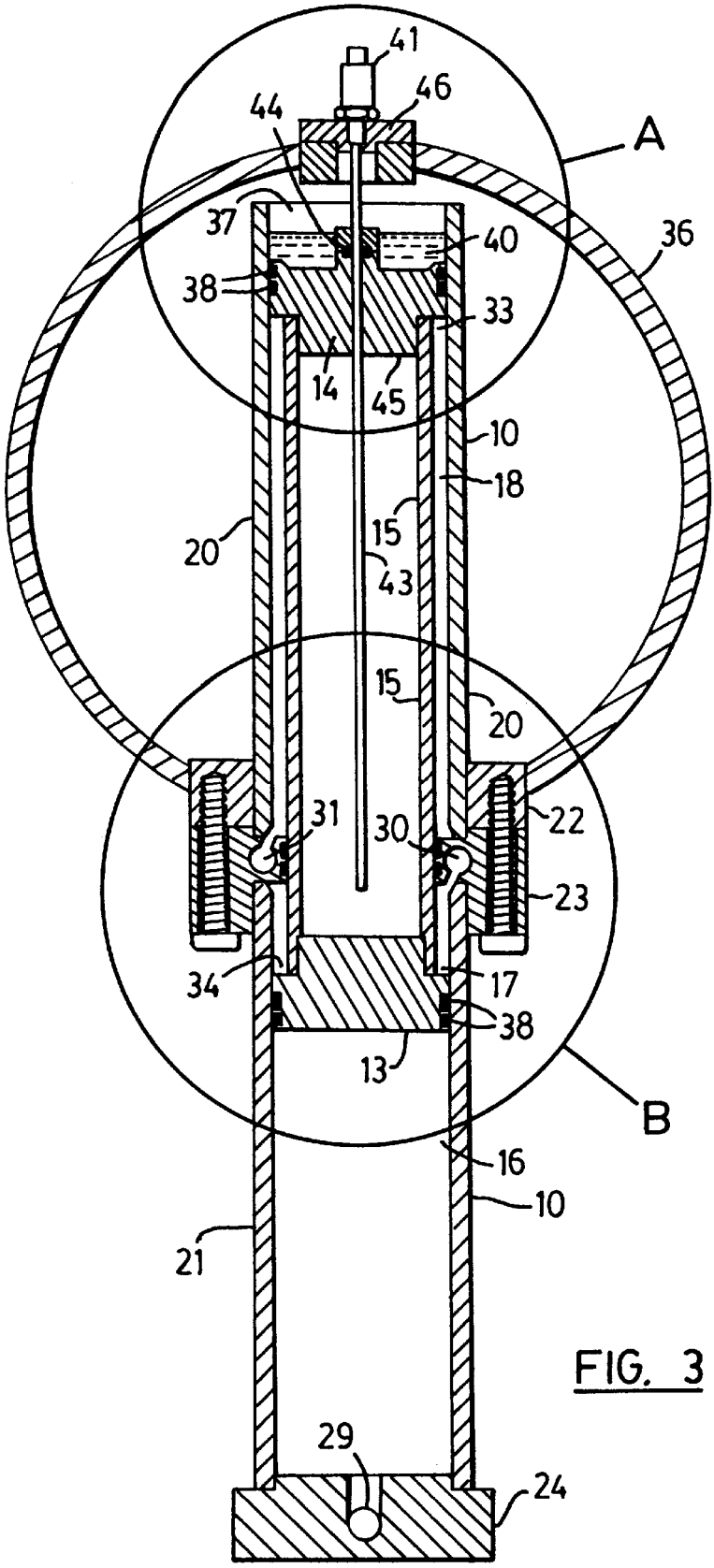
FIG. 3 is a cross-sectional side view of the master cylinder and accumulator in accordance with the preferred embodiment of the invention.
Figure 5:
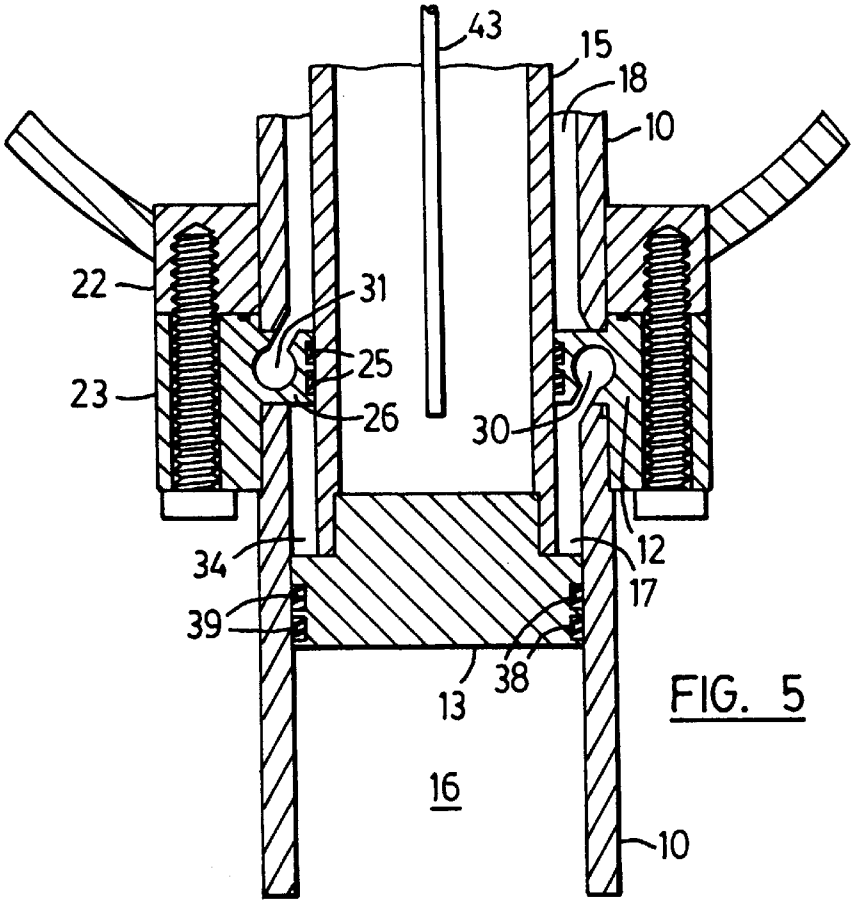
FIG. 5 is an enlarged and detailed view of segment "B" of FIG. 3.
Figure 4:
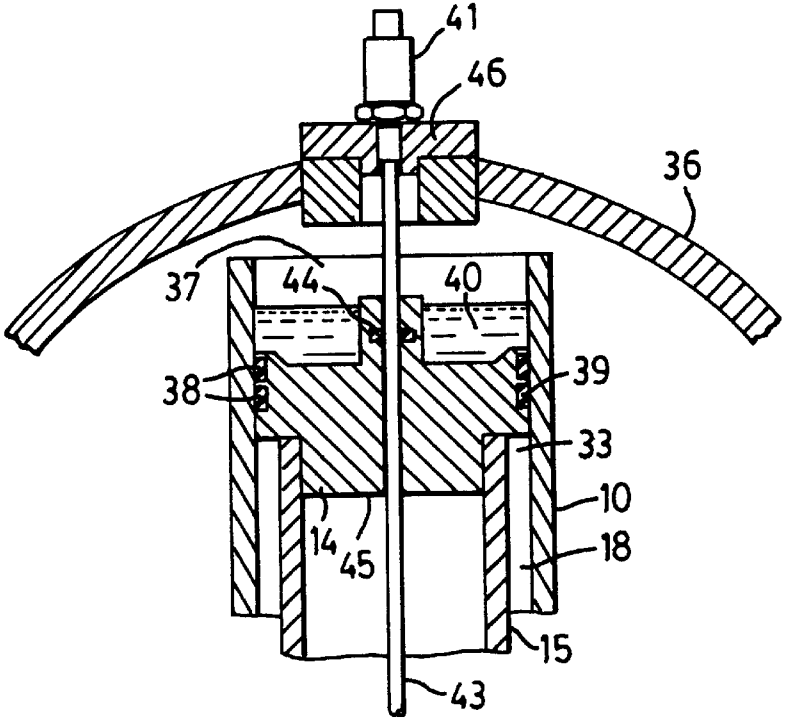
FIG. 4 is an enlarged and detailed view of segment "A" of FIG. 3.

With specific reference to FIGS. 3, 4 and 5, a more precise description of the configuration and structure of master cylinder 8 will be provided. For ease of manufacture, master cylinder 8 is preferably comprised of an upper portion 20 and a lower portion 21 connected by external flanges 22 and 23. Lower portion 21 of master cylinder 8 is fitted with a base or mounting plate 24 to allow the cylinder to be rigidly fixed to a support member or skid frame 72. Bulkhead 12 may take a variety of forms, however, in the preferred embodiment, and as shown in FIGS. 3 and 5, bulkhead 12 comprises an inwardly projecting radial flange 26 with bulkhead seal 25 positioned on its inner surface. Flange 26 provides a positive stop against which first and second piston heads 13 and 14 may bear in order to prevent further longitudinal movement in either direction. In addition, flange 26 enables seal 25 to tightly fit around connecting rod 15 so as to present a fluid tight seal and prevent the leakage of fluid between first and second master piston drive chambers 17 and 18. Similarly, seals 38, positioned on first piston head 13 and second piston head 14, create fluid tight seals between the piston heads and the cylinder shell to prevent the leakage of fluid between the piston heads and the shell wall. This configuration of seals prevents the cross-contamination of fluid and/or pressure between the internal chambers of master cylinder 8.

In order to hydraulically connect the various chambers of master cylinder 8 with the other aspects and features of drive system 1, a plurality of hydraulic ports are formed within the side of cylinder shell 10. A first hydraulic port 29 is positioned in the lower portion 21, and preferably in base plate 24, of master cylinder 8 such that it is in fluid communication with working fluid chamber 16. Hoses or pipes 35 form a hydraulic connection between port 29 and well head cylinders 2 and allow for the flow of fluid therebetween. As shown in FIG. 3, a second hydraulic port 30 is generally positioned within flange 22 and is in fluid communication with first master piston drive chamber 17. Similarly, a third hydraulic port 31 is also generally positioned in flange 23, however, it is in fluid communication with second master piston drive chamber 18. Hydraulic ports 29, 30 and 31 therefore allow for the entry and expulsion of fluid into and out of chambers 16, 17 and 18.

In order to apply a drive force to master piston 11 causing it to reciprocate within cylinder shell 10, hydraulic ports 30 and 31 are connected by way of hydraulic hoses or pipes 32 to hydraulic pump 7. Hoses 32 and pump 7 create a hydraulic drive system for master cylinder 8. As is shown most clearly in FIG. 1, in one direction of flow, fluid is drawn from first master piston drive chamber 17 through hydraulic pump 7 and forced into second master piston drive chamber 18. The pressurized fluid bears against flange 26 and against the interior surface 33 of second piston head 14. At the same time pressure is relieved and fluid extracted from first master piston drive chamber 17 resulting in an overall movement or driving of master piston 11 toward energy storage chamber 19. When the flow of hydraulic pump 7 is reversed the exact opposite flow pattern and movement of master piston 11 will occur. Specifically, fluid will be drawn out of second master piston drive chamber 18, through hydraulic pump 7 and into first master piston drive chamber 17. As fluid is pumped into first master piston drive chamber 17, pressure is exerted against the interior surface 34 of first piston head 13. At the same time the pressure in second master piston drive chamber 18 is reduced. As a result, master piston 11 will be driven in a direction toward working fluid chamber 16.

Accordingly, it will be appreciated that reversing the flow of hydraulic pump 7 will cause first and second master piston drive chambers 17 and 18 to be pressurized and de-pressurized on an alternating basis causing master piston 11 to reciprocate within cylinder shell 10. This reciprocation of piston 11 will also cause an alternating pressurizing and de-pressurizing of working fluid chamber 16 and energy storage chamber 19.

Working fluid chamber 16, well head cylinders 2, and hoses 35 are filled with working fluid and together comprise a working fluid system that is utilized to drive the pump rod. As the volume of working fluid chamber 16 is increased or decreased through movement of master piston 11, working fluid contained therein is either driven or extracted from well head cylinders 2 causing well head piston 5 to reciprocate, and in turn causing the reciprocation of pump rod 6 within the well. In this manner pump rod 6 can be reciprocated through hydraulically driving master cylinder 8 without the need for any external mechanical linkages, connecting rods, eccentric crank mechanisms, or other means that have been used to operate a master cylinder or oil well pump jack.

Hydraulic pump jack drive system 1 according to the present invention also includes an accumulator 36 that is hydraulically connected to energy storage chamber 19. Accumulator 36 serves two primary functions; the first of which is to act as a mechanism to help counter balance the weight of pump rod 6; and the second of which is to provide a means to store energy upon the combined downward stroke of the pump rod and the movement of master piston 11 toward chamber 19. In the preferred embodiment accumulator 36 is pressurized with a gas until the gas pressure within the accumulator exerts a sufficient pressure on second piston head 14 to cause master piston 11 to sufficiently pressurize working fluid chamber 16 so that working fluid is driven into oil well head cylinder 2 causing pump rod 6 to be lifted and balanced in a stationary position. Upon the pressurization of accumulator 36, the principal load placed upon well head cylinders 2 due to the weight of pump rod 6 will be generally balanced and reciprocation of the pump rod will only require sufficient further or additional energy to displace the pump rod from that balanced position.

Typically accumulator 36 would be pressurized from a source of high pressure gas when hydraulic pump jack drive system is installed and prior to operation. Due to the significant weight of the pump rod, for many wells pressures within accumulator 36 can exceed 1500 pounds per square inch. For that reason accumulator 36 would typically be formed with a spherical or arcuate interior surface in order to more evenly distribute the high internal stresses to which it may be subjected. While it may be possible to use a variety of different gases to pressurize accumulator 36, preferably nitrogen gas is used due to the fact that it is readily available, reasonably inexpensive, and generally inert. Similarly, due to its relative abundance and low cost, the working fluid in chamber 16 and well head cylinder 2, and the fluid in the hydraulic drive system for the master cylinder, is preferably hydraulic oil. Since the nitrogen gas is contained with an energy storage chamber and accumulator that are physically separated from the working fluid and hydraulic drive systems, the nitrogen is not emulsified in either the working fluid or the hydraulic drive oil. Emulsification of the nitrogen can reduce efficiency in the working fluid system, can cause cavitation in the hydraulic pump in the hydraulic drive system, and can affect the relative positioning of master piston 11 relative to well head piston 5 through compression of entrained nitrogen.

The second primary function of accumulator 36 is to act as an energy storage means during the downward stroke of pump rod 6. After pump rod 6 has been lifted to its uppermost position, the flow of hydraulic pump 7 will be reversed such that working fluid flows out of well head cylinders 2 allowing the pump rod 6 to fall in a downward stroke. When at its uppermost position, a significant amount of potential energy will reside in the pump rod, particularly in light of its very substantial weight After the flow of hydraulic pump 7 has reversed and pump rod 6 allowed to fall under the force of gravity, the potential energy of the pump rod is in effect transferred to accumulator 36 and stored in the form of pressurized nitrogen gas. The pump rod in effect drives well head cylinders downwardly forcing working fluid back into working fluid chamber 16. Increasing the pressure and fluid volume in working fluid chamber 16 results in a displacement of master piston 11 toward energy storage chamber 19 and thereby creates a resulting increase in internal pressure within energy storage chamber 19. Since accumulator 36 is hydraulically connected to energy storage chamber 19, the internal pressure within accumulator 36 will also rise.

Accordingly, accumulator 36 thereby serves as a means to store energy, in terms of the pressurization of gas therein, due to the downward stoke of pump rod 6. As mentioned previously, accumulator 36 also stores energy through the additional pressurization of its nitrogen gas through pump 7 driving master piston 11 toward chamber 19. Energy is thus imparted to the accumulator through both the downstroke of the pump rod and by the hydraulic pump. When pump rod 6 reaches its lowermost position the flow of hydraulic pump 7 will again be reversed such that the cycle can be repeated. Master piston 11 then drives working fluid from working fluid chamber 16 into well head cylinders 2, thus causing an upward stroke of the pump rod. When the direction of travel of master piston 11 reverses such that it is moving toward working fluid chamber 16, the built up internal pressure within energy storage chamber 19 and accumulator 36 will act upon second piston head 14 to assist in driving master piston 11 toward working fluid chamber 16. This action utilizes the stored potential energy within accumulator 36 to help lift pump rod 6.

As shown generally in FIG. 1, in the preferred embodiment, master cylinder 8 is vertically oriented having an open upper end 37. Accumulator 36 encompasses and contains open upper end 37 and is thereby hydraulically connected to energy storage chamber 19 through the open end of the master cylinder. This particular configuration of master cylinder 8 and accumulator 36 has been found to provide superior performance over systems having remote accumulators that are hydraulically connected to energy storage chambers by way of hoses or pipes since there are no pressure losses as are sometimes associated with hoses and piping. This structure also provides a simplified structure that occupies less space and is more portable in nature. In addition, since no hoses or pipes are required to connected accumulator 36 and energy storage chamber 19, the possibility for fluid leakage is reduced and the possibility of hose or pipe rupture is eliminated.

Orienting master cylinder 8 vertically allows for hydraulic pump jack drive system 1 to be contained and supported on a smaller skid frame 72 than would otherwise be possible if master cylinder 8 was horizontally mounted. The fact that there is no exterior mechanical linkage that physically drives master piston 11 also means that master cylinder 8 need not be braced and supported to the degree necessary for standard cam driven cylinders. Due to the reciprocation of the drive rod in a standard master cylinder system, it is critical that the master cylinder be firmly supported and braced such that it does not move during the substantial drive forces to which it is subjected. Such additional bracing and structural requirements is neither present nor necessary in hydraulic pump jack drive system 1, making it simpler to construct, lighter in weight, more portable, and less costly.

To help prevent the leakage of fluid between working fluid chamber 16, first master piston drive chamber 17, second master piston drive chamber 18 and energy storage chamber 19, seals 38 are provided on first and second piston heads 13 and 14, respectively. Seals 38, in conjunction with bulkhead seal 25, provide fluid tight chambers and eliminate or minimize leakage between those chambers. As shown in FIGS. 4 and 5, in the preferred embodiment a pair of seals 38 are utilized on both first and second piston heads 13 and 14. These seals are preferably receded within annular recesses 39 about the circumference of the piston heads. It will, however, be appreciated that other forms of sealing mechanisms could equally be used while staying within the scope of the invention. In addition, and as shown more particularly in FIG. 4, a relatively shallow oil bath 40 preferably rests on the upper surface of second piston head 14 in order to provide lubrication to seals 38 on the piston head. The vertical mounting of the master cylinder reduces the amount of oil needed in chamber 19 so that only a shallow bath 40 is required to cover the top of piston head 14.

Referring now to FIGS. 3 and 4, the present invention also includes a sensor 41 that generates a monitoring signal to monitor the position of master piston 11 as it reciprocates within master cylinder 8. Sensor 41 is connected to a control means 42 that receives the monitoring signal and generates a control signal to activate and reverse the flow of hydraulic pump 7 when necessary. That is, through the monitoring signal generated by sensor 41, control means 42 controls and operates hydraulic pump 7. Control means 42 also regulates the flow through the hydraulic drive system. Since master cylinder 8 and oil well head cylinders 2 are fixed volume hydraulic systems, monitoring the position of master piston 11 within master cylinder 8 will provide an indication as to the position of well head pistons 5 within oil well cylinders 2. Since pump rod 6 is mechanically linked to well head pistons 5, there is a direct relationship between the position of master piston 11 within master cylinder 8 and the position of pump rod 6 within the oil well. For this reason the position of master piston 11 can be used to control the position of the oil well head cylinders, and hence the pump rod, without the use of proximity switches or other mechanical linkages that have commonly been used at the well head. The ability to remove the need for such proximity switches or mechanical linkages through the employment of the present invention has clear advantages in terms of costs and reliability.

Typically the reciprocal displacement of a pump rod is measured in feet whereas the displacement of master piston 11 is usually a matter of inches. While the actual ratio of movement of master piston 11 to well head cylinder 2 will be dependent upon the diameter of each cylinder, ratios in the range of 4 to 1 are commonly achievable through use of the present invention. That is, a hydraulic pump jack drive system in accordance with the invention would allow for four inches of displacement of the well head piston 5 from a resulting 1 inch displacement of master piston 11. For this reason the range of movement which must be measured at the master piston is considerably less than the range that would have to be measured at the oil well head cylinders. Generally speaking, the types of sensors available to accurately monitor smaller ranges of movement are greater in number and less expensive than those used to accurately measure larger ranges of movement. Monitoring the movement of master piston 11 therefore provides a further advantage associated with the present invention.

In the preferred embodiment sensor 41 comprises a probe 43 and a magnetic field generator 44. Probe 43 is received into master cylinder 8 with magnetic field generator 44 being positioned on master piston 11. Typically magnetic field generator 44 would be comprised of a permanent magnet and probe 43 would include an induction coil such that as master piston 11 is reciprocated a voltage is induced within probe 43 creating an output monitoring signal. A commercially available probe that has been found to function adequately in these regards is known as a TEMPOSONIC™ probe. In the embodiment shown in FIGS. 3 and 4, probe 43 is received within a central bore 45 located in master piston 11 but other configurations and locations for probe 43 could equally be utilized while staying within the scope of the invention. A seal 46 prevents the escape of gas or fluid from around probe 43.

Through the use of sensor 41 an accurate and precise location of master piston 11 is known at all times. Due to the relationship between the position of master piston 11, well head piston 5, and pump rod 6, the velocity and the rate of acceleration and deceleration of the pump rod is controllable. In contrast, prior art devices that utilize proximity switches and mechanical linkages at the well head were only able to determine when the pump rod is at its upper most or lower most position. No mechanisms are available to identify the position of the pump rod between its upper and lower positions, nor is there any mechanism that allows for the determination or calculation of the velocity or the acceleration or deceleration of the pump rod.

Sensor 41 of the present invention therefore provides a very significant advantage over the prior art in that control means 42 is able to control the rates of acceleration and deceleration of the pump rod. This allows the operation and flow of hydraulic pump 7 to be regulated in order to prevent excessive jerking of the pump rod when it reverses direction. Due to the very significant weight of the rod, changing direction rapidly and without gradually decelerating the rod can put significant stress on the joints of the rod causing stretching, loosening, or in some cases even breakage. Control means 42 is therefore able to control the velocity of the pump rod during its operation to effectively lower the velocity at its upper and lower ends of travel. In effect, the combination of sensor 41 and control means 42 enables the acceleration and velocity curves for pump rod 6 to be smoothed out or flattened to remove excessive peaks and valleys that can occur through use of prior art devices which cause rapid reversals in direction.

Sensor 41 and control means 42 also allow for the fast and efficient change of the stroke length of the pump rod. In prior art systems utilizing connecting rods and mechanical linkages it was necessary to physically adjust the mechanical linkages in order to increase or decease the pump rod stroke length. Under the present invention the stroke length of pump rod 6 can be adjusted by control means 42 acting in conjunction with sensor 41. Once again, due to the relationship between the position of master piston 11 and pump rod 6, monitoring the position of the master piston through sensor 41 enables control means 42 to monitor and control the flow and operation of hydraulic pump 7. If necessary the stroke length of the pump rod in either its upward or downward directions can be adjusted through altering the flow of pump 7. The pump rod stroke length may thus be adjusted as desired due to ambient temperature variances and their effects upon the internal pressures of the gas in accumulator 36 and on the pump rod, and to compensate for rod stretching.

Control means 42 may be comprised of a single set of electric controls including relays, timers and switches to activate and reverse the flow of fluid through hydraulic pump 7. Preferably control means 42 also includes electronic circuits that can self-adjust the reciprocation of master piston 11, and hence pump rod 6, as needed. In more advanced systems control means 42 may comprise a microprocessor control that can be pre-programmed with command functions. Control means 42 may also be equipped with a modem to allow for off-site monitoring, programming and control.

The hydraulic pump jack drive system 1 also includes a pressure balancing valve 47 to automatically control and maintain pressure in accumulator 36 within a desired range. As shown schematically in FIG. 6, pressure balancing valve 47 is hydraulically connected to hydraulic pump 7 and to accumulator 36 through hoses 32. In the preferred embodiment pressure balancing valve 47 is a three position valve having a first, a second and a third position. In its first position valve 47 is closed to prevent the flow of fluid therethrough and to close off any connection between pump 7 and accumulator 36. When valve 47 is in its second position pressurized fluid from hydraulic pump 7 is able to flow into accumulator 36 to effectively increase the pressure within the accumulator. When valve 47 is in its third position excess pressure within accumulator 36 is reduced by allowing fluid to drain from the accumulator into a reservoir or dump 48. The fluid released into reservoir 48 will most often be hydraulic oil, however, where there is no oil present in accumulator 36 nitrogen gas will be allowed to escape.

Accordingly it will be appreciated that through the use of pressure balancing valve 47 the pressure within accumulator 36 can be maintained within pre-set limits. By operating to add or remove fluid to or from accumulator 36, pressure balancing valve 47 will maintain the pressure within the accumulator within pre-set limits in response to changes in pressure due to atmospheric temperature variations and/or fluid leakage from the system. Maintaining the pressure within accumulator 36 at a desired level is important from the perspective of the power demand placed upon motor 9. As discussed previously, the pressurization of accumulator 36 acts to "balance" pump rod 6 within the oil well. In this manner energy may be stored, by way of increased gas pressure in the accumulator, as the pump rod travels downwardly and recovered during the upward motion of the pump rod. Peak power demand on motor 9 is thus minimized as the power required is approximately equal during both halves of the pumping cycle.

In order for pressure balancing valve 47 to function effectively it must function in an automatic fashion. To this extent valve 47 is preferably a shuttle valve actuated in one direction by a spring 49 and in the opposite direction by pilot pressure from accumulator 36 applied through a pilot pressure tube 50. When accumulator 36 is adequately pressurized, pilot pressure tube 50 will deliver pressure to one end of valve 47, generally holding it in its first or closed position. In the event that the pressure within accumulator 36 drops below an acceptable limit the force applied by spring 49 will be sufficient to overcome the pilot pressure in tube 50 and will move valve 47 into its second position, allowing pressurized fluid to be pumped into accumulator 36 to increase the pressure therein. Once the pressure within accumulator 36 has been restored to its desired level, the pilot pressure applied through tube 50 will be such that it will overcome the force of spring 49 and return valve 47 to its closed position. In the event of an over pressurization of accumulator 36, the pilot pressure within tube 50 will move valve 47 into its third position allowing fluid within the accumulator to drain into reservoir 48.

In the preferred embodiment, in conjunction with automatic pressure balancing valve 47 is a pressure gauge 52 and a pressure gauge isolating valve 53. In addition, a valve 54 and coupling 55 may be included to provide a means to charge the accumulator with gas. Finally, a check valve 56 is preferably inserted into the high pressure line connecting pressure balancing value 47 to hydraulic pump 7 to prevent any back pressure or back flow from accumulator 36 into the hydraulic pump or the hydraulic drive system.

Figure 6:
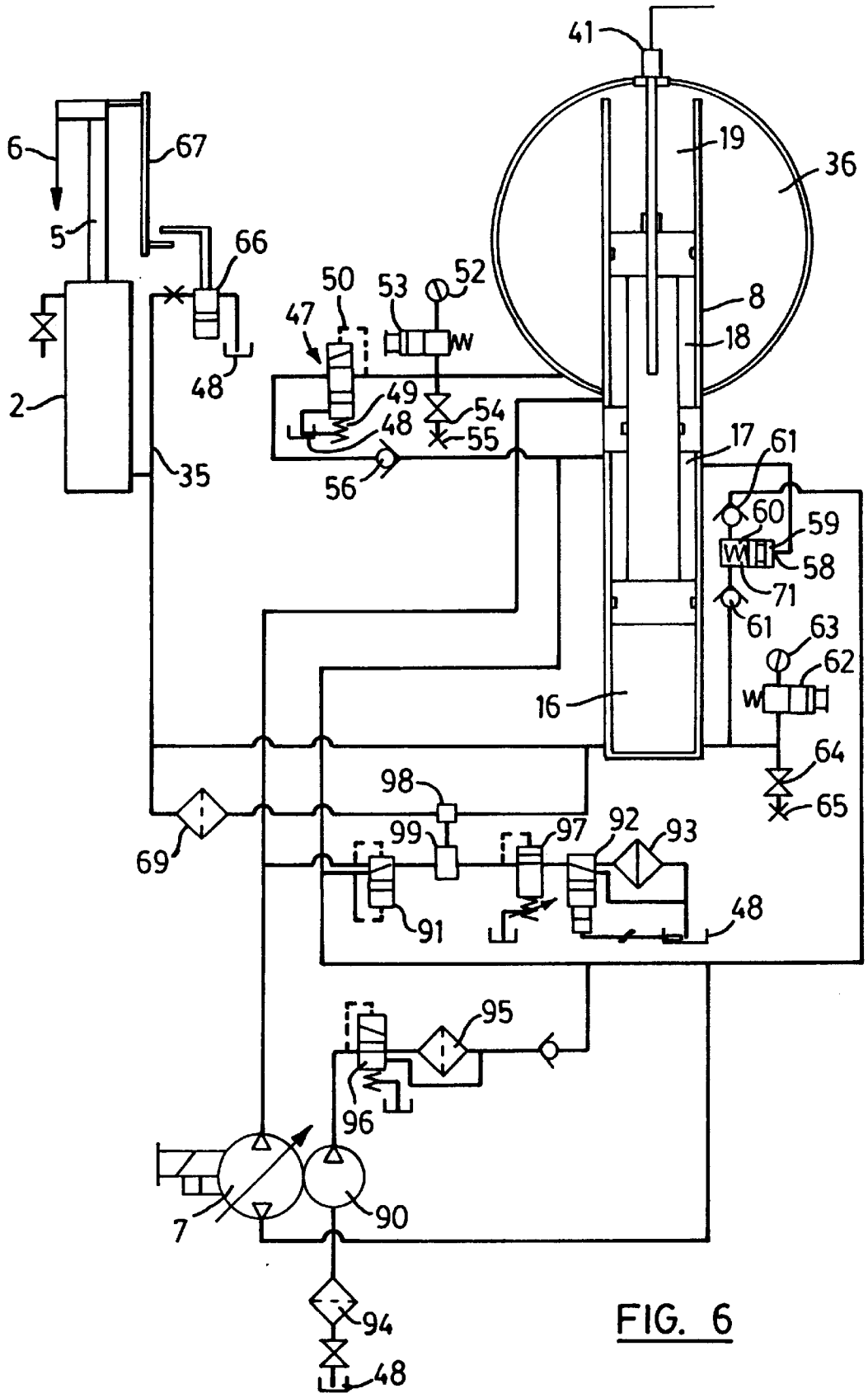
FIG. 6 is a schematic hydraulic flow diagram showing the control mechanisms of the preferred embodiment of the present invention.

While a single three-position pressure balancing valve 47 has been described and is shown in FIG. 6, it will be appreciated by those skilled in the art the art that, instead, a pair of two-position valves could be used while staying within the broad scope of the invention. In such a case one valve would control over-pressure situations with the other valve controlling under pressure situations.

Referring again to FIG. 6, in the preferred embodiment hydraulic pump jack drive system 1 includes a working fluid volume control system to automatically add working fluid to the working fluid system. The working fluid volume control system automatically adds high pressure working fluid from hydraulic pump 7 into the working fluid system in order to maintain fluid volumes within the system. The working fluid volume control system comprises a positive displacement pump 58, having a piston 59 and a chamber 71, that is driven by pressurized fluid from first master piston drive chamber 17. In this manner positive displacement pump 58 is actuated by the alternating pressurization of first master piston drive chamber 17.

Positive displacement pump 58 is hydraulically connected to both reservoir 48 and working fluid chamber 16. Upon the return stroke of pump 58 working fluid is drawn from reservoir 48. On the power stroke of pump 58, which corresponds to each pressurization of first master piston drive chamber 17, pump 58 injects the volume of working fluid that has been drawn from reservoir 48 into the working fluid system. That is, in effect, upon each stoke of the pump rod and master piston, a fixed volume of working fluid will be injected into the working fluid system.

Regardless of the tolerances to which parts are machined, and regardless of the types and forms of seals used, eventually in any hydraulic system, particularly those employing relatively high pressure such as the present, leakage will occur. The rate of leakage normally increases over the life of the seals and other components as parts that are in frictional contact tend to slowly wear out. While in many hydraulic systems leakage is relatively minor and of little consequence, in the hydraulic pump jack drive system of the present invention leakage within the working fluid system can result in a loss of balancing of the system and a significant loss of energy and pumping efficiency. The applicant has therefore found that through the employment of the above described working fluid volume control system a relatively small and fixed volume of working fluid can be injected into the working fluid system upon each alternating pressurization of first master piston drive chamber 17, or in other words upon each reciprocation of the master piston. This ensures that the working fluid system is constantly filled to capacity, thereby maintaining system balance and operating efficiency.

Since leakage volumes will be relatively minor, the displacement of pump 58 may be small. For example a pump having a chamber of approximately one quarter of one inch in diameter and a stroke of approximately one quarter of one inch will result in a displaced volume of approximately 0.012 milliliters. For a drive system having a stroke rate of 10 strokes per minute, over a 24 hour period pump 58 will inject approximately 173 milliliters of working fluid into the working fluid system. Pumping this volume of working fluid over a 24 hour period will have no appreciable effect on the power requirements for drive system 1 but will ensure that the volume of working fluid within the working fluid system is constantly maintained. It will be appreciated that amount of oil injected upon each stoke of pump 58 will be dependent upon the diameter and displacement of piston 59 within the pump. If desired a manual adjustment of the stroke length for pump 58 may be included in order to increase or decrease the displacement of piston 59 to suit particular operating needs.

As is shown in FIG. 6, a spring 60 is used to drive piston 59 in its reverse direction on the return stoke. A check valve 61 is also utilized to prevent back pressure or flow from the working fluid system from escaping. The working fluid system may also have hydraulically connected thereto an isolating valve 62 and pressure gauge 63 to measure pressure of the working fluid. A valve 64 and coupling 65 act as a means to initially charge or fill the working fluid system with working fluid.

In order to compensate for the over filling of the working fluid system, the present invention also preferably includes an over stroke valve 66 which is actuatable upon the lifting of pump rod 6 above a predetermined limit. Over stroke valve 66 is hydraulically connected to working fluid chamber 16, through connecting valve 66 with hydraulic hoses or pipes 35. Valve 66 is preferably a spool valve having a spring normally holding it in a closed position where no flow is permitted to pass through the valve. Valve 66 also has an open position that permits pressurized working fluid to flow through the valve and be drained from the working fluid system into reservoir 48. The movement of valve 66 from its normally closed position to its open position is accomplished through engagement of the valve with an actuator rod 67 which is mechanically connected to either pump rod 6 or well head piston 5.

In the event that the working fluid system is overfilled, reciprocation of master piston 11 will cause pump rod 6 to be lifted beyond its desired position. Once pump rod 6 is raised above a pre-determined upper limit, actuator rod 67 will engage over stroke valve 66 causing working fluid to be dumped or drained into reservoir 48. Fluid and pressure will be released from the working fluid system with each stroke of pump rod 6 until the remaining volume of working fluid in the system is such that it no longer causes pump rod 6 to rise above its pre-determined upper limit. At that point actuator rod 67 will no longer be lifted to a sufficient degree to engage over stroke valve 66. The internal spring within valve 66 will then maintain valve 66 in its closed position to prevent any further release or draining of fluid from the working fluid system. The operation of positive displacement pump 58 and over stroke valve 66 thereby control the volume of working fluid within the working fluid system to account for leakage and other losses, while at the same time preventing over filling of the system to the point that the pump rod is raised beyond acceptable limits. Positive displacement pump 58 and over stroke valve 66 also present a simplified and highly effective and durable method of achieving this result.

Since hydraulic pump jack drive system 1 operates as a closed system that operates under pressure the likelihood of contamination from outside the system is reasonably low. While in some instances contaminants may enter the system from outside it is expected that the primary source of contamination will be through the wearing of internal parts. In any event, contamination and particulates within the system can cause a decrease in efficiency and can also result in scoring of cylinder walls and damage to other parts of the system. For this reason, system 1 may also include a charge pump circuit that functions to both clean and control the temperature of the oil in the hydraulic drive system.

As shown in FIG. 6, the charge pump circuit operates through continuously removing a portion of the oil from the hydraulic drive system as it returns from either chambers 17 or 18 to pump 7. A two-position spool valve 91 controls the flow of oil into the charge pump circuit through permitting oil to be extracted from either chamber 17 or chamber 18. Valve 91 allows oil to be extracted from only the chamber having the lower pressure. After passing through spool valve 91 the oil passes through a pressure control valve 97 and then proceeds to a thermostatically controlled valve 92 that directs the oil in one of two different ways. If the temperature of the oil exceeds a predetermined level it is directed by valve 92 to a cooling unit 93 where it is cooled and then dumped into reservoir 48. If the oil does not require cooling, valve 92 sends the oil directly into reservoir 48, by-passing cooling unit 93.

The oil that is removed from the hydraulic drive system by spool valve 91 is replaced back into the system by charge pump 90. Pump 90 is preferably a small positive displacement pump that is connected to and driven by the operating shaft of pump 7. Pump 90 draws oil from reservoir 48 and through a filter 94 that removes contaminants. The oil is further filtered upon discharge from pump 90 by a filter 95. A spring/pilot pressure actuated valve 96 allows the discharge of pump 90 to by-pass filter 95 in the event that the filter becomes plugged or malfunctions. After either exiting filter 95 or by-passing the filter due to the operation of valve 96, the oil is returned to the hydraulic drive system. In the preferred embodiment, and as shown in FIG. 6, pump 58 is hydraulically connected to reservoir 48 through the charge pump circuit. That is, after exiting filter 95 a portion of the oil from the charge pump circuit is directed to and supplies pump 58 to provide pump 58 with a source of filtered oil.

As is also shown in FIG. 6, hydraulic pump jack drive system 1 preferably includes a working fluid filter system to remove contaminants that may either damage internal components of the drive system or that may reduce efficiency. To filter the working fluid the pressure of the oil exiting spool valve 91 is utilized to power a hydraulic motor 99 which in turn drives a hydraulic pump 98. Pump 98 receives oil from chamber 16 and passes it through a filter 69. After exiting filter 69 the filtered oil is delivered back into the working fluid system. While not specifically shown in FIG. 6, a by-pass valve may be utilized in conjunction with filter 69. It will be appreciated that this structure not only cleans the working fluid but enables some of the energy from the oil that is extracted from the hydraulic drive system through spool valve 91 to be recovered to power the working fluid filter system.

Figure 7:
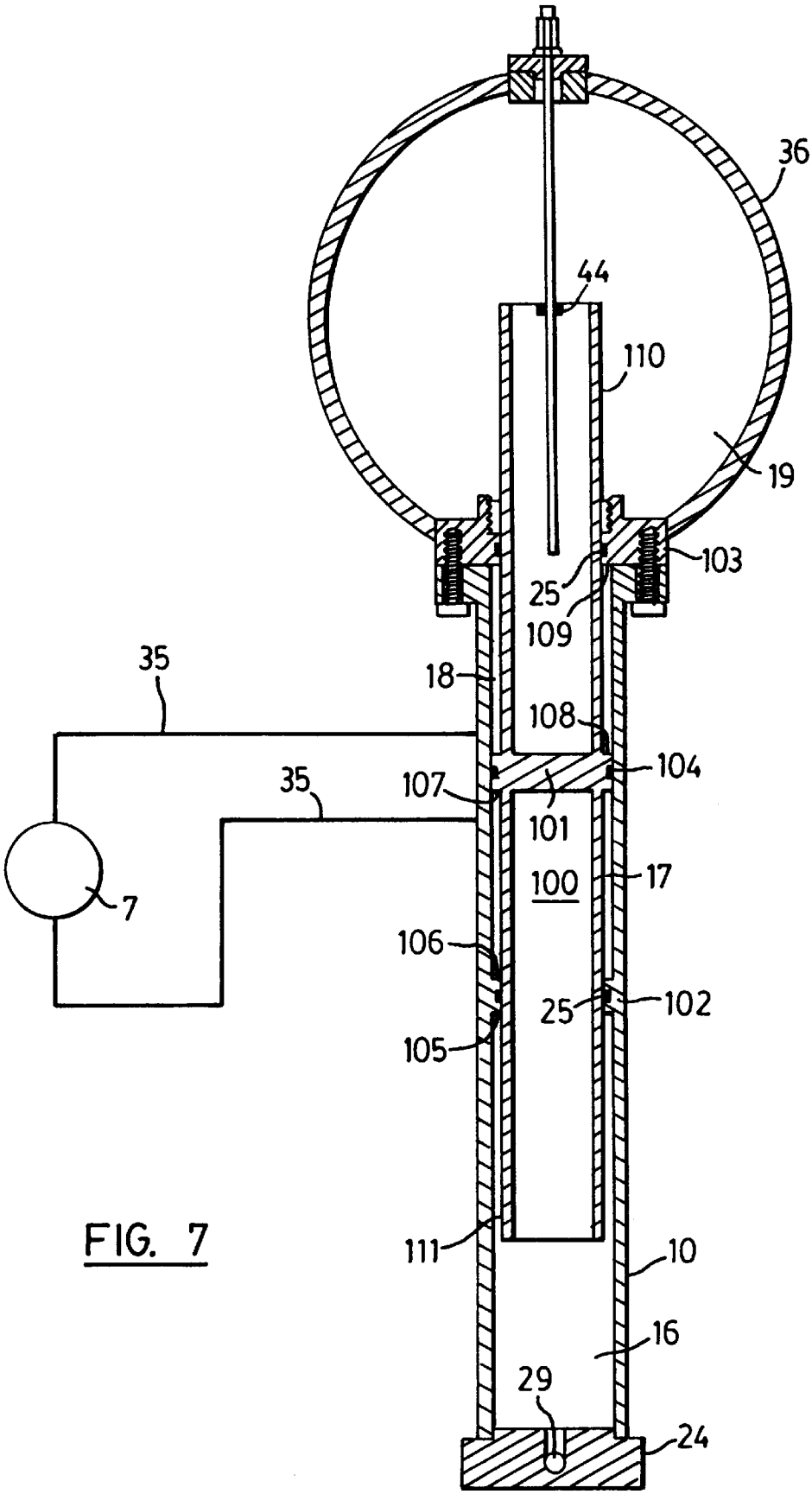
FIG. 7 is a schematic view of an alternate embodiment of the present invention; and, FIG. 8 is a schematic view of a further alternate embodiment of the present invention.

In FIG. 7 an alternate embodiment of master cylinder 8 is shown. Much of the structure of the embodiment shown in FIG. 7 is the same or similar to the perviously described embodiments. The primary difference in the embodiment shown in FIG. 7 is rather than having a master piston 11 comprised of first and second piston heads 13 and 14 joined by a connecting rod 15, FIG. 7 includes a master piston 100 having a single piston head 101 that is able to freely travel and float between a lower and an upper bulkhead 102 and 103, respectively. Bulkheads 102 and 103 are configured in a similar fashion as bulkhead 12 with bulkhead 102 located at approximately the middle portion of cylinder shell 10 and bulkhead 103 located at or near the upper portion of the cylinder shell. Bulkhead seals 25 are positioned on bulkheads 102 and 103 as they were on bulkhead 12 in the previous embodiment. A piston head seal 104 is positioned radially about piston head 101 in order to form a fluid tight seal with the cylinder shell and prevent passage of fluid between chambers 17 and 18.

It will therefore be appreciated that in the embodiment of FIG. 7, chamber 16 is defined by base 24, cylinder shell 10, and the lower surface 105 of bulkhead 102. Chamber 17 is defined by the upper surface 106 of bulkhead 102, cylinder shell 10, and the lower surface 107 of piston head 101. Similarly, chamber 18 is defined by the upper surface 108 of piston head 101, cylinder shell 10, and the lower surface 109 of bulkhead 103. An upper piston rod 110 and a lower piston rod 111 extend longitudinally through cylinder shell 10 and are respectively connected to upper and lower surfaces 108 and 107 of piston head 101, with upper piston rod extending through bulkhead 103 and lower piston rod extending through bulkhead 102. Through the use of seals 25, both piston rods form fluid tight seals with the bulkheads.

It will be appreciated that the function and operation of the embodiment shown in FIG. 7 will essentially be the same as that perviously described. Upon the alternating pressurization of chambers 17 and 18 piston head 101 will be driven in an upwardly or downwardly direction. As piston head 101 is driven upwardly, chambers 17 and 19 will be pressurized with a decrease in the pressurization of chamber 16 allowing pump rod 6 to move in a downward direction. When the flow of hydraulic fluid through pump 7 is reversed, causing piston head 101 to be driven in a downwardly direction, lower piston rod 111 causes pressurization of chamber 16 and a resulting upward movement of pump rod 6. All other operations of hydraulic pump jack drive system 1 are otherwise the same as in the previously described embodiment. Accordingly, it will be appreciated that whereas the embodiment shown in FIGS. 1 through 6 utilizes a master piston having two piston heads attached to a connecting rod that reciprocate about a single bulkhead, the embodiment of FIG. 7 functions essentially in the same fashion utilizing a single piston head having two outwardly extending piston rods where the piston head reciprocates between two separate bulkheads.

Figure 8:
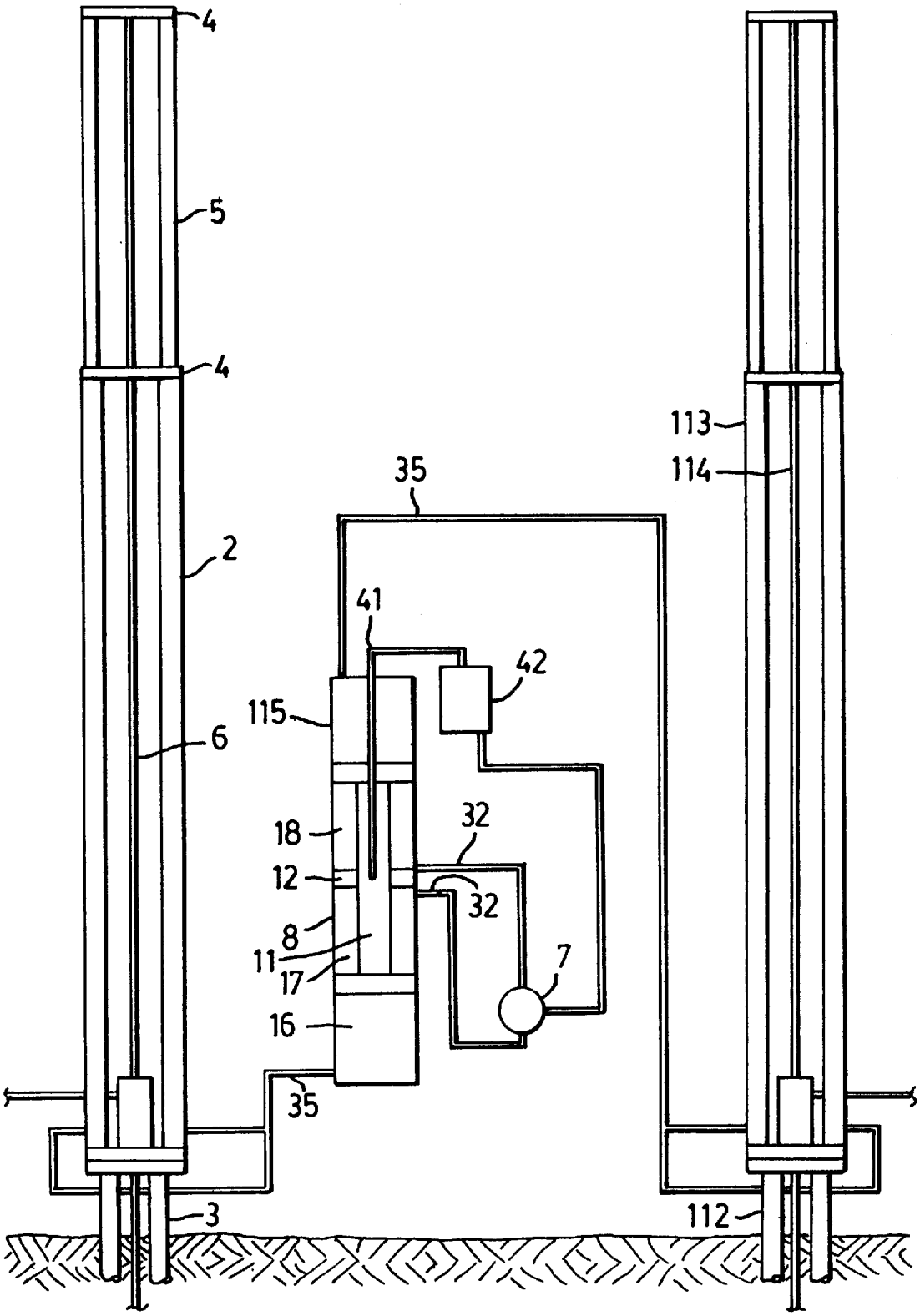

In FIG. 8 a further alternate embodiment of the present invention is shown schematically. The embodiment shown in FIG. 8 is similar in nature to that as shown in FIG. 1 with the exception that FIG. 8 concerns the application and use of the hydraulic pump jack drive system of the present invention in association with a dual well pumping arrangement. In this embodiment a second oil well 112 is fitted with a second set of well head cylinders 113 that are attached to a pump rod 114. Master cylinder 8 includes a second working fluid chamber 115 that is connected by way of hoses 35 to the well head cylinders 113. In the same way in which working fluid chamber 16 is pressurized in order to reciprocate pump rod 6, the master cylinder alternately pressurizes and de-pressurizes second working fluid chamber 115 in order to cause the pump rod 114 in the second oil well 112 to be reciprocated.

As indicated in FIG. 8, preferably second working fluid chamber 115 is positioned at the opposite end of master piston 11 relative to working fluid chamber 16. In this manner as the master piston is reciprocated within cylinder shell 10, working fluid chambers 16 and 115 are pressurized and de-pressurized on an alternating basis. It will thus be appreciated that this alternating pressurization of the working fluid chambers will have the result of causing the reciprocation of the two pump rods on an alternating basis. That is, as one pump rod is lifted the other will be lowered, and vice versa. It will be equally appreciated by those skilled in the art that energy transferred to the working fluid through the lowering of one of the pump rods will help to drive master piston 11 in a direction that causes the lifting of the other pump rod. In this way the potential energy of a lifted pump rod can be used to help drive the master piston when lifting the other pump rod.

The above described hydraulic pump jack drive system and its internal components have been shown to provide an efficient and portable drive system that contains a number of significant advancements and improvements over prior systems. Master piston 11 provides the driving force that operates well head cylinders 2. Since master piston 11 is driven internally through alternatingly pressurizing first and second master piston drive chambers 17 and 18, there are no external drive rods or eccentric cam drives adding to the system weight, complexity and expense. Furthermore, there are no external seals that are required when driving the master piston reducing the possibility of leakage or failure of the cylinder. Large gear boxes that are standard on traditional pump jacks are not required under the present invention, again reducing both the weight and expense of the drive system and also removing a critical element that is subject to potential mechanical failure and breakdown. Through the use of hydraulic pump 7 to drive master piston 11, the reciprocation of piston 11 can be more accurately controlled in terms of velocity, acceleration and reversal in direction.

Whereas prior art systems typically experience high peak velocities at the point where their connecting rods are perpendicular to their eccentric drive cams, under the present invention hydraulic pump 7 can be controlled to lower peak velocities to create a smoother velocity and acceleration curve of less amplitude, thereby reducing pump rod stretching and jerking during reversal. Ideally, and particularly in heavy oil wells, the pump rod should be lifted relatively fast on its upward stroke in order to quickly pump oil from the well and allowed to descend on its down stroke at a slower rate to permit the down hole pump to completely fill with oil prior to repeating the cycle. The drive systems of prior pump jacks lift and lower the pump rod at the same rate. Under the present invention the control of hydraulic pump 7 can be adjusted to allow for different rates of lifting and lowering of the pump rod.

A further advantage of the present invention is centred in the physical separation of the hydraulic drive system from the working fluid system. The relative sizes and volumes of the first and second master piston drive chambers, 17 and 18 respectively, is small meaning that hydraulic pump 7 need only be able to pump relatively small volumes of fluid. This allows for a physically smaller pump to be utilized. With a smaller pump a savings in cost, weight and energy to drive the pump is realized. Whereas the constant pressure in the working fluid system can exceed 2500 pounds per square inch due to the weight of the pump rod, since the hydraulic drive system is separate and distinct from the working fluid system, hydraulic pump 7 is not constantly subjected to such high pressures. Pump 7 must withstand high discharge pressures but operates under a low inlet pressure. For this reason a standard commercially available pump may be used. Pumps having both high inlet and outlet pressures must often be custom made and tend to be large, expensive and heavy. In addition, under the structure of the present invention, and contrary to prior art devices, hydraulic pump 7 does not start under load. For this reason the standard types of clutches and transmissions utilized on prior art devices to enable pumps starting under high loads are not required.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A hydraulic pump jack drive system for reciprocating an oil well pump rod, the drive system comprising:

at least one hydraulic well head cylinder having a well head piston, said well head piston connected to the oil well pump rod causing the pump rod to reciprocate in the oil well upon raising and lowering of said well head piston;

a reversible flow hydraulic pump; and, a master cylinder having a cylinder shell, a free floating master piston retained therein, and at least one fixed bulkhead, said master cylinder having a working fluid chamber hydraulically connected to said hydraulic well head cylinder, and at least two master piston drive chambers hydraulically connected to said hydraulic pump, wherein the cyclical reversing of the flow of said hydraulic pump causes said master piston drive chambers to be pressurized and de-pressurized on an alternating basis to reciprocally move said master piston within said master cylinder, said reciprocating master piston causing an alternating pressurizing and de-pressurizing of said working fluid chamber and said well head cylinder thereby causing the pump rod to reciprocate within the oil well.

2. A device as claimed in claim 1 wherein said master cylinder has a lower and an upper fixed bulkhead and said master piston has a piston head having an upper and a lower piston rod extending therefrom and situated longitudinally within said cylinder shell, said piston head being positioned between said upper and said lower fixed bulkheads and said upper and lower piston rods extending through said respective upper and lower fixed bulkheads with said bulkheads forming fluid tight seals therewith.

3. A device as claimed in claim 2 having two master piston drive chambers comprising a first master piston drive chamber defined by said lower bulkhead, said cylinder shell and said piston head, and a second master piston drive chamber defined by said upper bulkhead, said cylinder shell and said piston head.

4. A device as claimed in claim 1 wherein said master piston has a first and a second piston head joined by a connecting rod, said first and second piston heads being positioned on opposite sides of said bulkhead with said bulkhead bearing against said connecting rod to form a fluid tight seal therewith.

5. A device as claimed in claim 4 having two master piston drive chambers comprising a first master piston drive chamber defined by said first piston head, said cylinder shell and said bulkhead, and a second master piston drive chamber defined by said second master piston head, said cylinder shell and said bulkhead.

6. A device as claimed in claim 5 including energy storage means to store potential energy upon the lowering of the pump rod within the oil well.

7. A device as claimed in claim 6 wherein said energy storage means includes an energy storage chamber forming part of said master cylinder.

8. A device as claimed in claim 7 including an accumulator hydraulically connected to said energy storage chamber, said accumulator pressurized with a gas and providing a means to counter balance the weight of the pump rod and a means to store energy upon the downward stroke of the pump rod.

9. A device as claimed in claim 8 wherein said hydraulic well head cylinder and said working fluid chamber are filled with a working fluid and define a working fluid system, and said master piston drive chambers and said hydraulic pump are filled with hydraulic fluid and define a hydraulic drive system.

10. A device as claimed in claim 9 wherein said accumulator is pressurized with a gas such that the gas pressure within said accumulator exerts a force on said master piston sufficient to pressurize said working fluid chamber to lift the pump rod to a sufficient degree such that the load on said hydraulic pump is approximately balanced during the reciprocation of said master piston in either direction.

11. A device as claimed in claim 10 including a sensor that generates a monitoring signal to monitor the position of said master piston as it reciprocates.

12. A device as claimed in claim 11 further including a control means for operating said hydraulic pump, said control means receiving said monitoring signal from said sensor and generating a control signal to activate and reverse the flow of fluid through said hydraulic pump.

13. A device as claimed in claim 12 wherein said control means provides a means to control the reversal rate of said hydraulic pump to adjust the stroke rate of the pump rod, and a means to control said hydraulic pump flow such that the flow from said hydraulic pump may be adjusted to control the upward and downward velocity and acceleration of the pump rod.

14. A device as claimed in claim 13 further including a filter and a cooling unit to clean and cool said hydraulic fluid.

15. A device as claimed in claim 14 wherein said sensor comprises a probe and a magnetic field generator positioned on said master piston, said probe received into said master cylinder and said magnetic field generator inducing a voltage in said probe, said induced voltage fluctuating with movement of said master piston and creating said monitoring signal.

16. A device as claimed in claim 15 wherein said master cylinder is generally vertically oriented with an open upper end, said accumulator encompassing and containing said open upper end.

17. A device as claimed in claim 16 including seals on said piston head and on said bulkhead to prevent leakage of fluid between said working fluid chamber, said master piston drive chambers, and said energy storage chamber.

18. A device as claimed in claim 17 wherein said hydraulic pump is a swash plate pump.

19. A device as claimed in claim 18 wherein said magnetic field generator is a permanent magnet attached to said master piston.

20. A device as claimed in claim 19 wherein said gas in said accumulator is nitrogen.

21. A device as claimed in claim 20 wherein said control means is a microprocessor.

22. A device as claimed in claim 8 including at least one pressure balancing valve to automatically control and maintain pressure in said accumulator within a desired range, said pressure balancing valve being hydraulically connected to said hydraulic pump and to said accumulator.

23. A device as claimed in claim 22 having one pressure balancing valve, said pressure balancing valve having a first, a second, and a third position such that when in said first position said pressure balancing valve is closed with no fluid flowing therethrough, when in said second position pressurized fluid from said hydraulic pump is able to flow into said accumulator to pressurize said accumulator, and when in said third position excess pressure within said accumulator is released.

24. A device as claimed in claim 9 including a working fluid volume control system to automatically add working fluid to said working fluid system.

25. A device as claimed in claim 24 wherein said working fluid volume control system adds high pressure fluid from said hydraulic pump to said working fluid system.

26. A device as claimed in claim 24 wherein said working fluid volume control system comprises a positive displacement pump that is driven by pressurized fluid from said first master piston drive chamber such that said positive displacement pump is actuated upon the alternating pressurization of said first master piston drive chamber, said positive displacement pump thereby injecting a fixed volume of fluid into said working fluid system upon alternating pressurization of said first master piston drive chamber.

27. A device as claimed in claim 26 wherein said working fluid volume control system further includes an over stroke valve actuatable upon the lifting of the pump rod above a pre-determined limit, said over stroke valve hydraulically connected to said working fluid system and having a closed position preventing the flow of fluid therethrough and an open position allowing pressurized fluid to drain from said working fluid system, said over stroke valve being biased toward said closed position and operable to said open position through engagement with an actuator rod, said actuator rod engaging said over stroke valve upon the lifting of the pump rod above said predetermined limit.

28. A device as claimed in claim 1 wherein said master cylinder includes a second working fluid chamber hydraulically connected to a hydraulic well head cylinder that reciprocates the pump rod in a second oil well.

29. A device as claimed in claim 28 wherein said alternating pressurization and depressurization of said master cylinder piston drive chambers cause the reciprocation of the pump rods in the oil wells on an alternating basis.

* * * * *